US008884853B2

(12) United States Patent
Kim et al.

(10) Patent No.: US 8,884,853 B2
(45) Date of Patent: Nov. 11, 2014

(54) ORGANIC LIGHT EMITTING DIODE DISPLAY DEVICE AND METHOD FOR DRIVING THE SAME

(75) Inventors: Keun-Choul Kim, Seoul (KR); Chang-Hoon Jeon, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 29 days.

(21) Appl. No.: 13/297,419

(22) Filed: Nov. 16, 2011

(65) Prior Publication Data

US 2012/0127150 A1 May 24, 2012

(30) Foreign Application Priority Data

Nov. 18, 2010 (KR) ..... 10-2010-0114939

(51) Int. Cl.
*G09G 3/30* (2006.01)
*G09G 3/32* (2006.01)
*G09G 3/10* (2006.01)

(52) U.S. Cl.
CPC ..... *G09G 3/3233* (2013.01); *G09G 2300/043* (2013.01); *G09G 2300/0861* (2013.01); *G09G 2300/0842* (2013.01)
USPC ..... 345/78; 315/169.3

(58) Field of Classification Search
USPC ..... 345/76–83
See application file for complete search history.

(56) References Cited

U.S. PATENT DOCUMENTS 6,008,632 A * 12/1999 Sasaki ..... 323/313
7,382,340 B2 6/2008 Kim et al.
7,742,029 B2 * 6/2010 Jung et al. ..... 345/92
8,130,181 B2 * 3/2012 Jeon et al. ..... 345/78
2002/0171611 A1 * 11/2002 Cok ..... 345/82
2004/0239596 A1 * 12/2004 Ono et al. ..... 345/76
2004/0263436 A1 * 12/2004 Okuda ..... 345/76
2005/0275606 A1 * 12/2005 Wu ..... 345/76
2006/0022907 A1 * 2/2006 Uchino et al. ..... 345/76

(Continued)

FOREIGN PATENT DOCUMENTS

CN 1588529 A 3/2005
CN 1677470 A 10/2005

(Continued)

OTHER PUBLICATIONS

First Notification of Office Action dated Nov. 27, 2013, from The State Intellectual Property Office of China in counterpart Chinese application No. 201110366225.5.

(Continued)

*Primary Examiner* — Adam J Snyder
(74) *Attorney, Agent, or Firm* — Morgan, Lewis & Bockius LLP

(57) ABSTRACT

The present invention an organic light emitting diode display device includes a display panel having a plurality of pixel regions, a gate driving unit for driving gate lines and light emitting control lines of the display panel, a data driving unit for driving data lines of the display panel, a power supply unit for supplying first and second power signals to power lines of the display panel as well as a compensating voltage to a compensating power line, and a timing controller for controlling the gate and data driving units for displaying an image with a data voltage compensated with the compensating voltage and controlling the power supply unit to supply the compensating voltage after converting a level of the compensating voltage just before display of a first image on the display panel at an initial driving.

10 Claims, 5 Drawing Sheets

(56) References Cited

U.S. PATENT DOCUMENTS

| | | | | |
|---|---|---|---|---|
| 2006/0028408 | A1 | 2/2006 | Kim | |
| 2006/0113918 | A1* | 6/2006 | Lo et al. | 345/82 |
| 2006/0208976 | A1* | 9/2006 | Ikeda | 345/76 |
| 2007/0164937 | A1 | 7/2007 | Jung et al. | |
| 2009/0015522 | A1* | 1/2009 | Ono | 345/76 |
| 2009/0167648 | A1 | 7/2009 | Jeon et al. | |
| 2009/0206770 | A1 | 8/2009 | Hong et al. | |
| 2011/0096059 | A1* | 4/2011 | Ohhashi | 345/76 |

FOREIGN PATENT DOCUMENTS

| | | | | |
|---|---|---|---|---|
| CN | 101345022 | A | 1/2009 | |
| CN | 101471032 | A | 7/2009 | |
| KR | 10-2007-0006331 | A | 1/2007 | |
| KR | 10-2009-0070371 | A | 7/2009 | |
| WO | WO 2010/016316 | A1 * | 2/2010 | G09G 3/30 |

OTHER PUBLICATIONS

Office Action dated Mar. 13, 2014, from the Korean Patent Office in counterpart Korean Chinese application No. 10-2010-0114939.

Office Action dated May 15, 2014, from The State Intellectual Property Office of China in counterpart Chinese application No. 201110366225.5.

* cited by examiner

ORGANIC LIGHT EMITTING DIODE DISPLAY DEVICE AND METHOD FOR DRIVING THE SAME

CROSS REFERENCE TO RELATED APPLICATION

This application claims the benefit of the Patent Korean Application No. 10-2010-0114939, filed on Nov. 18, 2010, which is hereby incorporated by reference as if fully set forth herein.

BACKGROUND OF THE DISCLOSURE

1. Field of the Disclosure

The present invention relates to an organic light emitting diode display device and a method for driving the same which can prevent drive error that is liable to take place at initial turning on of the organic light emitting diode display device for improving reliability of the same, and in which an image voltage charged to each of unit pixels is compensated to improve a display picture quality, further.

2. Discussion of the Related Art

As flat display devices on the rise currently, there are liquid crystal display devices, field emission display devices, plasma display panels, organic light emitting display devices, and so on. Of the flat display devices, the organic light emitting diode display device is a spontaneous emission device which makes an organic light emitting layer to emit a light as an electron and a hole re-couple and is expected to be the next generation display device owing to high brightness, a low driving voltage and possibility of fabrication of an extra-thin device.

Each of a plurality of pixels of the OLED display device is provided with an organic light emitting diode having the organic light emitting layer between an anode and a cathode, and a pixel circuit for driving the organic light emitting diode, independently.

The pixel circuit is provided with switching transistors, capacitors, and driving transistors, principally. The switching transistor charges a data signal to the capacitor in response to a scan pulse, and the driving transistor controls current intensity being supplied to the organic light emitting diode according to a data voltage charged to the capacitor for producing gradients.

However, the organic light emitting diode display device has had defects in that the drive error takes place, in which a power source current is applied to the pixels, particularly, to the pixel circuits at the time of initial driving of the organic light emitting diode display device, making the organic light emitting diodes in the pixel to emit a light. In other words, in a normal of operation of the organic light emitting diode display device, at the time of initial driving of the organic light emitting diode display device, the power source current is supplied for driving the organic light emitting diode display device at first, and then, different control signals are generated for displaying an image on a display panel. However, a related art organic light emitting diode display device causes the drive error in which the power source current applied to the display panel at the time of initial driving is applied to the pixels, making the organic light emitting diode to emit the light. Consequently, the related art organic light emitting diode display device causes the drive error, such as blinking, at the time of the initial turning on, impairing reliability thereof.

SUMMARY OF THE DISCLOSURE

An object of the present invention is to provide an organic light emitting diode display device and a method for driving the same.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an organic light emitting diode display device includes a display panel having a plurality of pixel regions, a gate driving unit for driving gate lines and light emitting control lines of the display panel, a data driving unit for driving data lines of the display panel, a power supply unit for supplying first and second power-signals to power lines of the display panel as well as a compensating voltage to a compensating power line, and a timing controller for controlling the gate and data driving units for displaying an image with a data voltage compensated with the compensating voltage, and controlling the power supply unit to supply the compensating voltage after converting a level of the compensating voltage just before display of a first image on the display panel at an initial driving.

The timing controller, at the time of initial driving of the display panel, generates and supplies a level converting control signal to the power supply unit such that the level of the compensating voltage is converted from the ground voltage level which is a level of the second power signal to a level of a preset straight polarity compensating voltage just before the image is displayed on a first horizontal line of the display panel, and the power supply unit converts the level of the compensating voltage to be supplied to the compensating power line to the ground level or the preset straight polarity level in response to the level converting control signal.

The display panel or the power supply unit further includes a compensating voltage supply unit for supplying the compensating voltage to the compensating voltage supply line after converting a compensating voltage level to the ground voltage level or the preset straight polarity compensating voltage level.

The compensating voltage supply unit is provided with NMOS and PMOS switching devices connected in series between the ground voltage application terminal and a preset straight polarity compensating voltage application terminal for supplying the compensating voltage of the preset straight polarity compensating voltage level or the ground voltage level to the compensating voltage supply line according to the level converting control signal.

The gate driving unit supplies at least one of the gate voltage and the light emitting voltage to the gate lines or the light emitting control lines after reducing application periods of the gate voltage and the light emitting voltage as much as a-preset time period for at least an initial one frame period.

In another aspect of the present invention, a method for driving an organic light emitting diode display device includes the steps of driving gate lines and light emitting control line of a display panel having a plurality of pixel regions, driving data lines of the display panel, supplying first and second power signals to power lines of the display panel as well as a compensating voltage to a compensating power line, and controlling to display an image with a data voltage compensated with the compensating voltage and controlling to supply the compensating voltage after converting a level of the compensating voltage just before display of a first image on the display panel at an initial driving.

The step of supplying the compensating voltage after converting a level of the compensating voltage includes the steps of, at the time of initial driving of the display panel, generating and supplying a level converting control signal to the power supply unit such that the level of the compensating voltage is converted from the ground voltage level which is a level of the second power signal to a level of a preset straight polarity compensating voltage just before the image is displayed on a first horizontal line of the display panel, and converting the level of the compensating voltage to be supplied to the compensating power line to the ground level or the preset straight polarity level in response to the level converting control signal.

The step of supplying the compensating voltage after converting a level of the compensating voltage includes the step of supplying the compensating voltage to the compensating voltage supply line after converting a compensating voltage level to the ground voltage level or the preset straight polarity compensating voltage level by using a compensating voltage supply unit provided to the display panel or a separate power supply unit.

The step of supplying the compensating voltage includes the step of supplying the compensating voltage of the preset straight polarity compensating voltage level or the ground voltage level to the compensating voltage supply line according to the level converting control signal by using NMOS and PMOS switching devices connected in series between the ground voltage application terminal and a preset straight polarity compensating voltage application terminal.

The method further includes the step of supplying at least one of the gate voltage and the light emitting voltage to the gate lines or the light emitting control lines after reducing application periods of the gate voltage and the light emitting voltage as much as a preset time period for at least an initial one frame period.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DESCRIPTION OF SPECIFIC EMBODIMENTS

Reference will now be made in detail to the specific embodiments of the present invention, examples of which are illustrated in the accompanying drawings. Wherever possible, the same reference numbers will be used throughout the drawings to refer to the same or like parts.

Figure 1:
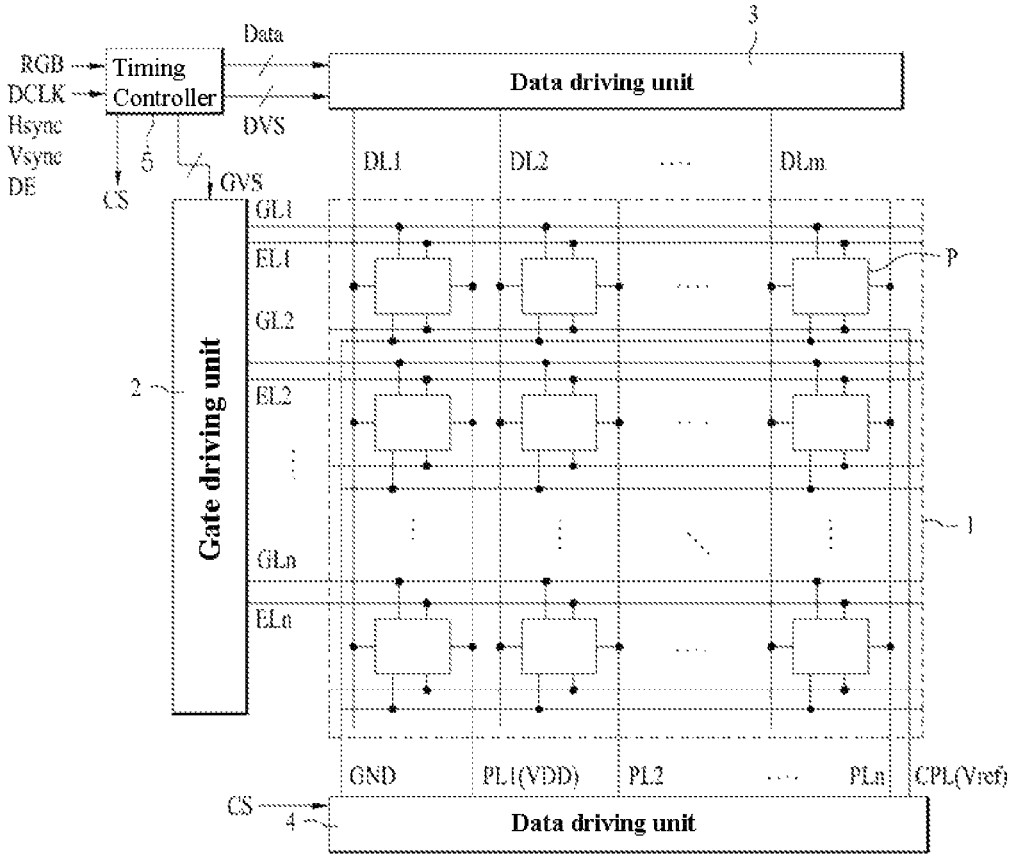
FIG. 1 illustrates a block diagram of an organic light emitting diode display device in accordance with a preferred embodiment of the present invention.
Figure 2:
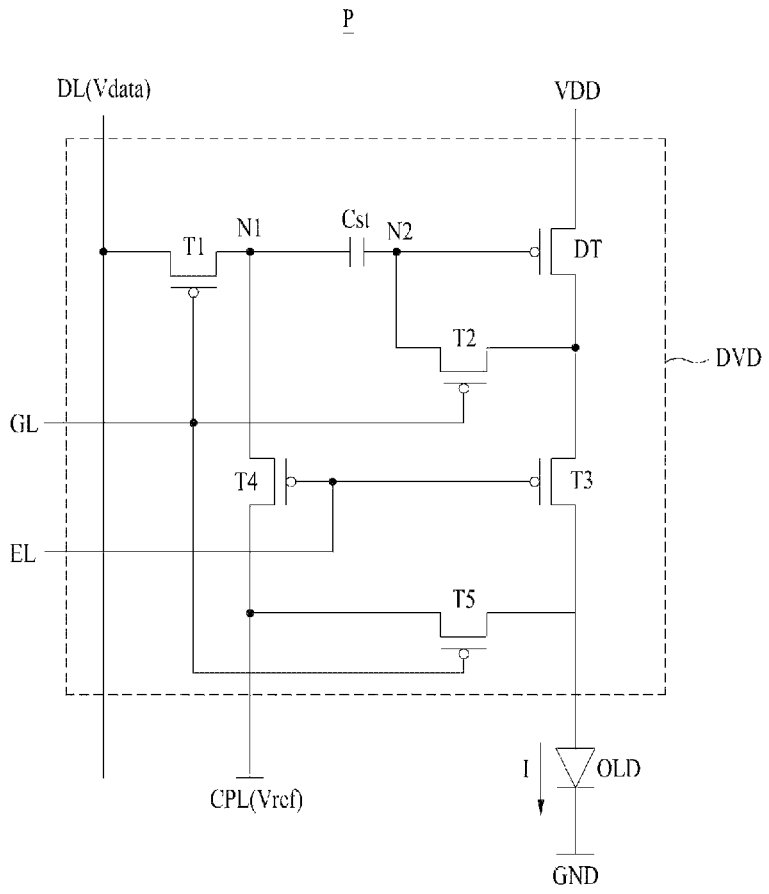
FIG. 2 illustrates an equivalent circuit of a sub-pixel of the display panel in FIG. 1.

FIG. 1 illustrates a block diagram of an organic light emitting diode display device, in accordance with a preferred embodiment of the present invention. And, FIG. 2 illustrates an equivalent circuit of a sub-pixel of the display panel in FIG. 1.

Referring to FIG. 1, the organic light emitting diode display device includes a display panel 1 having a plurality of pixel regions, a gate driving unit 2 for driving gate lines GL1~GLn and light emitting control lines EL1~ELn of the display panel 1, a data driving unit 3 for driving data lines DL1~DLm of the display panel 1, a power supply unit 4 for supplying first and second'power signals VDD, and GND to power lines PL1~PLm as well as a compensating voltage Vref to a compensating power line CPL, and a timing controller 5 for controlling the gate and data driving units 2, and 3 for displaying an image with a data voltage compensated with the compensating voltage Vref and controlling the power supply unit 4 to supply the compensating voltage Vref after converting a level of the compensating voltage Vref just before display of a first image on the display panel 1 at an initial driving.

The display panel 1 has a matrix of pixel regions each having a plurality of sub-pixels P for displaying the image. Each of the sub-pixels P includes a light emitting cell OLD, and a cell driving unit DVD for driving the light emitting cell OLD, independently. In detail, as shown in FIG. 2, each of the sub-pixels P includes a gate line GL, a data line DL, a compensating power line CPL, a light emitting control line EL, a cell driving unit DVD, expressed as a diode in equivalency, connected to the power line PL, and a light emitting cell OLD connected between the cell driving unit DVD and the second power signal GND.

The cell driving unit DVD includes first to fifth switching devices T1~T5, a drive switching device DT, and a storage capacitor Cst. In this instance, the first to fifth switching devices T1~T5, and the drive switching device DT may be NMOS transistors or PMOS transistors. Hereinafter, an example will be described, in which the first to fifth switching devices T~T5, and the drive switching device DT are the PMOS transistors.

The first switching device T1 supplies a data signal Vdata from the data line DL to a first node N1 in response to a low logic gate voltage from the gate line GL for charging the storage capacitor Cst.

The second switching device T2 connects the gate electrode to the drain electrode of the drive switching device DT in response to a low logic gate voltage from the gate line GL for connecting the drive switching device DT in a form of a diode.

The third switching device T3 connects the drain electrode of the drive switching device DT to an anode electrode of the light emitting cell OLD in response to a low logic light emitting control voltage from the light emitting control line EL. That is, the third switching device T3 supplies a data current from the drive switching device DT to the light emitting cell OLD according to the low logic light emitting control voltage.

The fourth switching device T4 supplies the compensating voltage Vref supplied through the compensating power line CPL to the first node N1.

The fifth switching device T5 supplies the compensating voltage Vref supplied through the compensating power line CPL to a third node N3 connected to the light emitting cell OLD in response to the low logic gate voltage from the gate line GL. In this instance, the fifth switching device T5, being a cell driving unit DVD stabilizing device, does not influence to a driving process even if the fifth switching device T5 is not provided.

The drive switching device DT controls an intensity of a current to the light emitting cell OLD in response to a voltage at the second node N2.

The storage capacitor Cst is formed between the first and second nodes N1 and N2 for storage of a difference of voltages between the first and second nodes N1 and N2 therein, and sustains a turned on state of the drive switching device DT for a preset time period, for an example, one frame period, by using a voltage stored therein if the first switching device T1 is turned off.

The light emitting cell OLD includes the anode electrode connected to the cell driving unit DVD, a cathode electrode connected to the second power source signal GND which is a low potential voltage, and an organic layer formed between the anode electrode and the cathode electrode. The light emitting cell OLD emits the light with the current from the drive switching device DT through the third switching device T3 of the cell driving unit DVD.

The gate driving unit 2 generates gate on signals (For an example, a low logic gate voltage) in succession in response to gate control signals GVS, for an example, a gate start pulse GSP and a gate shift clock GSC, from the timing controller 5, and controls a pulse width of each of the gate on signals according to a gate output enable signal GOE. Then, the gate on signals are supplied to the gate lines GL1~GLn in succession. In this instance, in each of periods in which the gate on signals are supplied to the gate lines GL1~GLn, a gate off voltage (For an example, a high logic gate voltage) is supplied. According to this, the gate driving unit 2 drives the first and second switching devices T1 and T2 connected to each of the gate lines GL1~GLn. In this instance, the gate driving unit 2 also supplies the high logic gate voltage during a data input period in one horizontal period, and the low logic gate voltage during a scan period in the one horizontal period. In this case, in the data input period, the data voltage is supplied to the light emitting cells OLD, not during the data input period, but during the scan period.

And, the gate driving unit 2 generates high or low logic light emitting control voltages in succession and supplies the same to the light emitting control lines EL1~ELn. In this instance, the light emitting control voltages forwarded in succession controls a period in which a current flows to the light emitting cell OLD, i.e., a period the image is displayed, and a period the compensating voltage Vref is supplied to the fourth switching device T4. In other words, the gate driving unit 2 controls an image display period and a blanking period in which a black image is displayed.

The data driving unit 3 converts a digital image data received from the timing controller 5 to an analog voltage, i.e., an analog data voltage by using a source start pulse SSP and a source shift clock SSC of the data control signals from the timing controller 5. In this instance, the data driving unit 3 converts the digital image data to the analog data voltage by using a gamma voltage set having gamma voltages finely divided to match to gradients of the digital image data. And, the data driving unit 3 supplies the data voltage to the data lines DL1~DLm in response to the source output enable SOE signal. In detail, the data driving unit 3 latches the digital image data received according to the SSC, and supplies one horizontal line portion of the data voltage to the data lines DL1~DLn in every horizontal period in which the gate on signal is supplied to the gate lines GL1~GLn in response to the SOE signal.

The power supply unit 4 supplies the first and second power signals VDD and GND to the power lines PL1~PLm of the display panel 1, and the compensating voltage Vref to the compensating power line CPL. The power supply unit 4 converts a level of the compensating voltage Vref being supplied to the compensating power line CPL in response to a level converting control signal CS from the timing controller 5 to a preset straight polarity level or a ground level and supplies the same.

The timing controller 5 aligns RGB data received from an outside with a size and resolution of the display panel 1, and supplies the digital image data aligned thus to the data driving unit 3. And, the timing controller 5 generates the gate and data control signals by using synchronizing signals received from an outside, such a dot clock DCLK, a data enable signal DE, a horizontal synchronizing signal Hsync, a vertical synchronizing signal Vsync, and supplies the gate and data control signals to the gate driving unit 2 and the data driving unit 3, respectively.

Moreover, at the time of initial driving of the display panel 1, the timing controller 5 generates and supplies the level converting control signal CS to the power supply unit 4 such that the level of the compensating voltage Vref is converted from the ground voltage level to the preset straight polarity compensating voltage Vref level just before the image is displayed on a first horizontal line of the display panel 1. According to this, the power supply unit 4 converts the compensating voltage Vref level to the ground level or the preset straight polarity level in response to the level converting control signal CS from the timing controller 5.

Figure 3:
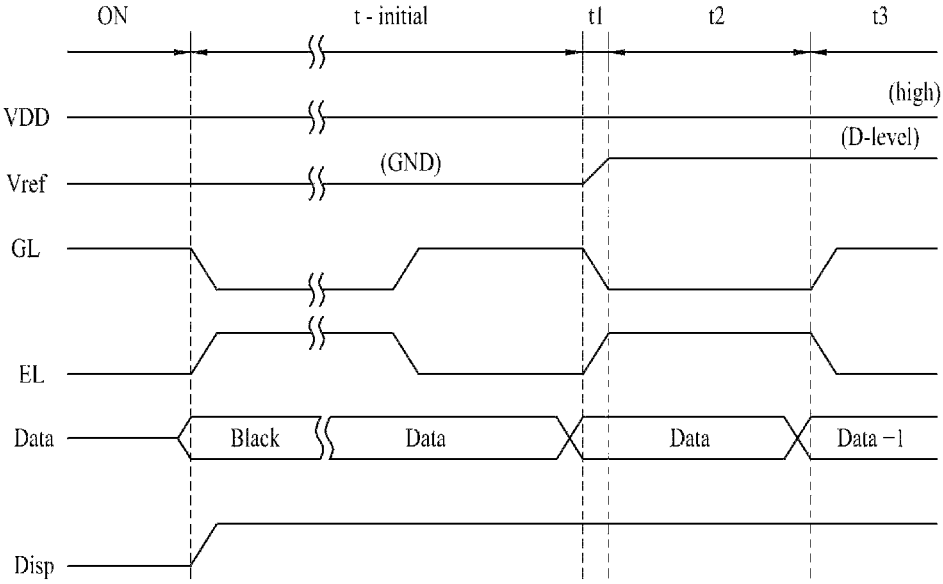
FIG. 3 illustrates waveforms for describing a method for driving an organic light emitting diode display device in accordance with a preferred embodiment of the present invention.

FIG. 3 illustrates waveforms for describing a method for driving an organic light emitting diode display device in accordance with a preferred embodiment of the present invention.

A time period from a time the user turns on the organic light emitting diode display device to a time the image is displayed on the display panel 1 is divided into a power signal turn on period, an initial driving period t_initial, and a frame period t1~t3.

The power signal turn on period is a most initial time period in which the user supplies the power signal for using the organic light emitting diode display device, when the power signal is supplied to, starting from the power supply unit 4, the gate and data driving units 2 and 3, and the timing controller 5 for the first time. In the turn on period, no signal is supplied to the display panel 1.

Then, in the initial driving period t_initial, an initial driving signal Disp is supplied from the timing controller 5 to the data driving units 2 and 3 or the power supply unit 4. In response to the initial driving signal Disp, all the data driving unit 2 and 3 and the power supply unit 4 are enabled. In this instance, since the display panel 1 has the first and second power signals VDD and GND supplied thereto, a current is liable to be supplied to the pixels to cause the drive error. As a counter measure to this, the timing controller 5 supplies a black data to the data driving unit 3 so that the black is displayed on the display panel even if the drive error takes place. And, the data driving unit 3 supplies a data voltage corresponding to the black data to the data lines DL1~DLm. The gate driving unit 2 supplies the gate voltage and the light emitting control voltage to the gate lines GL1~GLn and the light emitting control line EL1~ELn so that the black data supplied to the data lines DL1~DLm is displayed.

In the meantime, in the initial driving period t_initial, the timing controller 5 generates and supplies the level converting control signal CS to the power supply unit 4 for maintaining the compensating voltage Vref at the ground voltage level. And, the power supply unit 4 also maintains the compensating voltage Vref at the ground voltage level and supplies the same to the compensating power line CPL. This is for passing the first power signal VDD supplied to the cell driving unit DVD to the compensating power line CPL even if the drive error takes place at the sub-pixels of the display panel 1, i.e., at the cell driving units DVD in the initial driving period t_initial. In this case, even if the drive error takes place at the cell driving unit DVD, since the first power signal VDD passes to the compensating power line CPL, without giving any influence to the light emitting cell OLD, no light is emitted.

The frame period t1~t3, i.e., a frame period of each pixel, after the initializing process is performed is divided into an initializing period t1, a data charging period t2, and a light emitting period t3.

In the initializing period t1, the low logic gate voltage is supplied to a relevant gate line GL in succession. And, the high logic light emitting control voltage is supplied to a relevant light emitting control line EL. According to this, the first, second and fifth switching devices T1, T2 and T5 of each sub-pixel P are turned on, and the third and fourth switching devices T3 and T4 are turned off.

In the initializing period t1, the timing controller 5 generates and supplies the level converting control signal CS to the power supply unit 4 such that the compensating voltage Vref level is supplied after converted from the ground voltage level to a preset straight polarity compensating voltage Vref level. According to this, the power supply unit 4 supplies the compensating voltage Vref after converting the compensating voltage Vref level to the preset straight polarity compensating voltage level D_level in response to the level converting control signal CS.

Then, in the data charging period t2, the data voltage is supplied from the data line DL to the first node N1 through the first switching device T1 turned on thus, and the gate electrode and the drain electrode of the drive switching device DT are connected to each other through the second switching device T2 turned on thus. Since the drive switching device DT becomes a forward direction diode according to this, supplying a threshold voltage Vth of the drive switching device DT to the gate electrode of the drive switching device DT, i.e., the second node N2, the threshold voltage Vth of the drive switching device DT is sampled from the second node N2. In this instance, as the first power signal VDD which is a high potential voltage is supplied to the source electrode of the drive switching device DT, a difference VDD-Vth of voltages of the first power signal VDD and the threshold voltage of the drive switching device DT is supplied to the second node N2.

In the light emitting period t3, the high logic gate voltage is supplied to a relevant gate line GL, and the low level light emitting control signal is supplied to the light emitting control line EL. According to this, the first, second and fifth switching devices T1, T2 and T5 are turned off and the third and fourth T3 and T4 switching devices are turned on. In this instance, the compensating voltage Vref is supplied to the first node N1 through the fourth switching device T4 turned on thus.

In this instance, voltages at both terminals of the storage capacitor Cst are maintained constant as no current pass is formed at the cell driving unit DVD. According to this, the voltage at the second node N2 which is the other terminal of the storage capacitor Cst changes as much as a voltage change Vref-Vdata on the first node N1 which is one terminal of the storage capacitor Cst. That is, the second node N2 has a VDD−Vth+Vref−Vdata supplied thereto.

Then, the drive switching device DT is turned on by a voltage between the gate-source electrodes. According to this, a current supplied to the light emitting cell OLD from the drive switching device DT through the third switching device T3, i.e., a third node N3 current N3I can be expressed as an equation 3 below. In the equation 3, β is a constant, and Vth_R is an actual threshold voltage of the drive switching device DT.

$$N3I = \beta/2(Vgs - \mathrm{Vth_R})_2 \tag{1}$$
$$= \beta/2(Vdd - Vth + Vc - Vdata - Vdd - \mathrm{Vth_R})^2$$
$$= \beta/2(Vref - Vdata - Vth - \mathrm{Vth_R})^2$$

In the equation 1, if the threshold voltage Vth of the drive switching device DT sampled thus and an actual threshold voltage Vth_R of the drive switching device DT are the same, a current to the drive switching device DT is fixed by the compensating voltage Vref and the data voltage Vdata without being influenced by a voltage drop of the high potential voltage VDD and the threshold voltage of the drive switching device DT. According to this, a picture quality drop caused by hysteresis of the drive switching device DT can be minimized.

Figure 4:
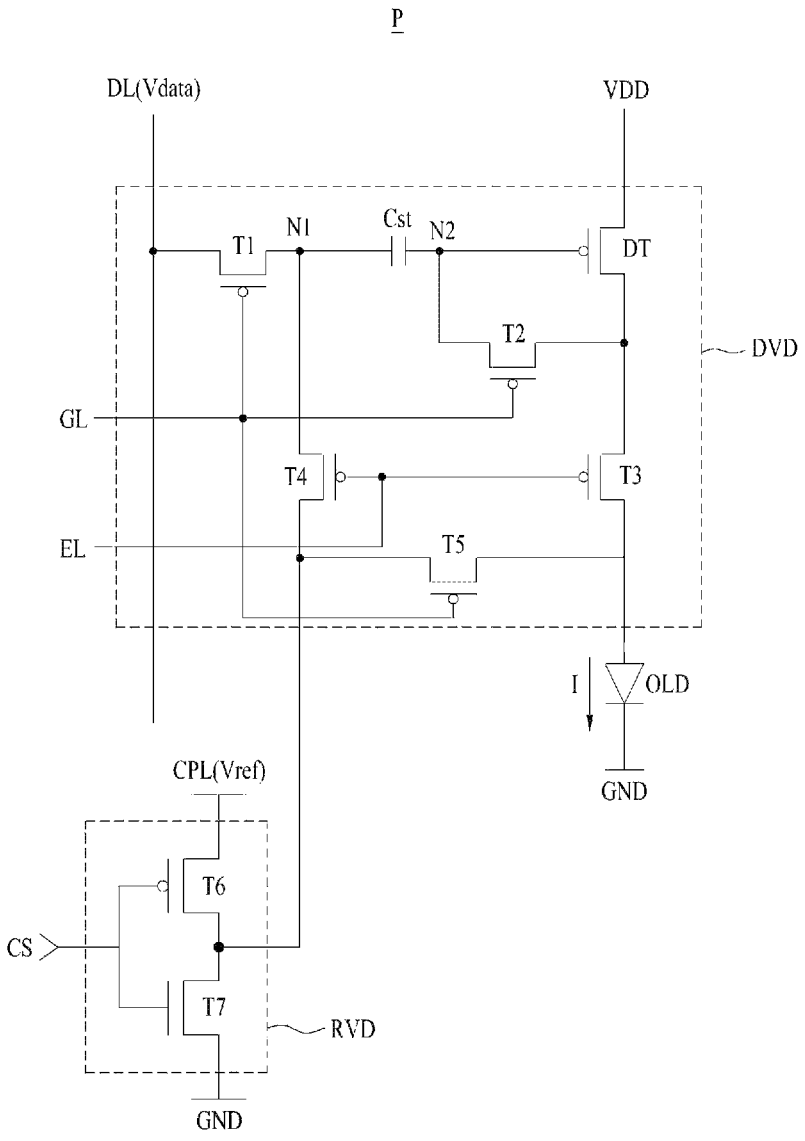
FIG. 4 illustrates an equivalent circuit showing a structure for supplying a compensating voltage to any one of the sub-pixels in FIG. 2.

FIG. 4 illustrates an equivalent circuit showing a structure for supplying a compensating voltage to any one of the sub-pixels in FIG. 2.

Referring to FIG. 4, the display panel 1 or the power supply unit 4 of the present invention may further include a compensating voltage supply unit RVD for supplying the compensating voltage Vref to the sub-pixels P of the display panel 1, particularly the compensating voltage supply line CPL of the cell driving unit DVD after converting a compensating voltage Vref level to the ground voltage GND level or the preset straight polarity compensating voltage Vref level.

In detail, the compensating voltage supply unit RVD provided to the display panel 1 or the power supply unit 4 is provided with NMOS and PMOS switching devices connected in series between the ground voltage GND application terminal and a preset straight polarity compensating voltage Vref application terminal for supplying the compensating voltage of the preset straight polarity compensating voltage Vref level or the ground voltage GND level to the compensating voltage supply line CPL according to the level converting control signal CS.

Figure 5:
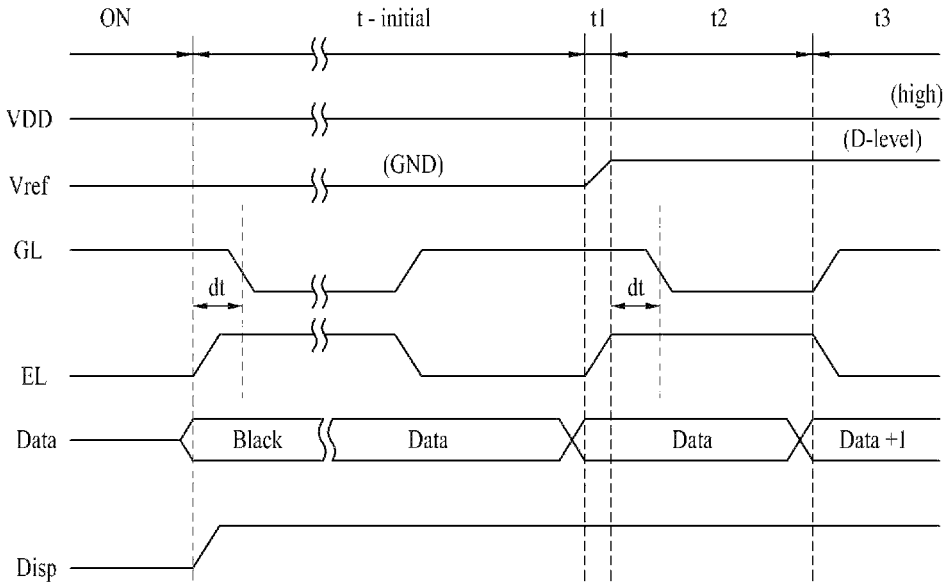
FIG. 5 illustrates other waveforms for describing a method for driving an organic light emitting diode display device in accordance with a preferred embodiment of the present invention.

FIG. 5 illustrates other waveforms for describing a method for driving an organic light emitting diode display device in accordance with a preferred embodiment of the present invention.

As described in detail with reference to FIG. 3, a time period from a time the user turns on the organic light emitting diode display device to a time the image is displayed on the display panel 1 is divided into a power signal turn on period, an initial driving period t_initial, and a frame period t1~t3.

A method for driving the display panel 1 in the power signal turn on period, the initial driving period t_initial, and the frame period t1~t3 is identical to the driving method described with reference to FIG. 3.

However, referring to FIG. 5, the gate driving unit 2 of the present invention may supply the gate voltage to the gate lines GL1~GLn in succession after reducing an application period of the gate voltage as much as a preset time period dt for at least an initial one frame period. In the meantime, though not shown, separate from the gate voltage, the gate driving unit 2 may supply the light emitting voltage to the light emitting control lines EL1~ELn in succession after reducing an application period of the light emitting voltage as much as the preset time period dt for at least the initial one frame period.

In this case, even if the drive error takes place at least one cell driving unit DVD for at least initial one frame period, a time period of the cell driving unit DVD can be reduced, reducing the influence thereof.

As has been described, the organic light emitting diode display device and the method for driving the same of the present invention can improve a display quality of the image by compensating an image voltage being charged to the pixels P and improve reliability of the display device by preventing drive error liable to take place at an initial turn on of the organic light emitting diode display device.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An organic light emitting diode display device, a time period from a time a user turns on the organic light emitting diode display device to a time an image is displayed on a display panel being divided into a power signal turn on period, an initial driving period, and a frame period, the frame period being divided into an initializing period, a data charging period, and a light emitting period, comprising:

the display panel having a plurality of pixel regions;

a gate driving unit for driving gate lines and light emitting control lines of the display panel;

a data driving unit for driving data lines of the display panel;

a power supply unit for supplying first and second power signals to power lines of the display panel as well as a compensating voltage to a compensating power line; and a timing controller for controlling the gate and data driving units for displaying the image with a data voltage compensated with the compensating voltage, and supplying a level converting control signal to the power supply unit to convert a level of the compensating voltage, wherein the timing controller generates and supplies the level converting control signal to the power supply unit for maintaining the compensating voltage at a ground voltage level in the initial driving period when the power signal is supplied to, and generates and supplies the level converting control signal to the power supply unit such that the compensating voltage level is supplied after converted from the ground voltage level to a preset straight polarity compensating voltage level in the initializing period of the frame period of each pixel.

2. The device as claimed in claim 1, wherein the power supply unit converts the level of the compensating voltage to be supplied to the compensating power line to the ground level or the preset straight polarity level in response to the level converting control signal.

3. The device as claimed in claim 2, wherein the display panel or the power supply unit further includes a compensating voltage supply unit for supplying the compensating voltage to the compensating voltage supply line after converting a compensating voltage level to the ground voltage level or the preset straight polarity compensating voltage level.

4. The device as claimed in claim 3, wherein the compensating voltage supply unit is provided with NMOS and PMOS switching devices connected in series between the ground voltage application terminal and a preset straight polarity compensating voltage application terminal for supplying the compensating voltage of the preset straight polarity compensating voltage level or the ground voltage level to the compensating voltage supply line according to the level converting control signal.

5. The device as claimed in claim 4, wherein the gate driving unit supplies at least one of the gate voltage and the light emitting voltage to the gate lines or the light emitting control lines after reducing application periods of the gate voltage and the light emitting voltage as much as a preset time period for at least an initial one frame period.

6. A method for driving an organic light emitting diode display device, a time period from a time a user turns on the organic light emitting diode display device to a time an image is displayed on a display panel being divided into a power signal turn on period, an initial driving period, and a frame period, the frame period being divided into an initializing period, a data charging period, and a light emitting period, comprising the steps of:

driving gate lines and light emitting control line of the display panel having a plurality of pixel regions;

driving data lines of the display panel;

supplying first and second power signals to power lines of the display panel as well as a compensating voltage to a compensating power line; and controlling to display the image with a data voltage compensated with the compensating voltage and controlling to supply the compensating voltage after converting a level of the compensating voltage, wherein the step of controlling to supply the compensating voltage after converting a level of the compensating voltage includes, supplying the level converting control signal to a power supply unit for maintaining the compensating voltage at a ground voltage level in the initial driving period when a power signal is supplied to, and supplying the level converting control signal to the power supply unit such that the compensating voltage level is supplied after converted from the ground voltage level to a preset straight polarity compensating voltage level at the initializing period of the frame period of each pixel.

7. The method as claimed in claim 6, wherein the step of controlling to supply the compensating voltage after converting a level of the compensating voltage includes;

converting the level of the compensating voltage to the ground voltage level or the preset straight polarity level in response to the level converting control signal.

8. The method as claimed in claim 7, wherein the step of converting a level of the compensating voltage includes;

converting the level of the compensating voltage to the ground voltage level or the preset straight polarity compensating voltage level by using a compensating voltage supply unit provided to the display panel or a separate power supply unit.

9. The method as claimed in claim 8, wherein the compensating voltage of the preset straight polarity compensating voltage level or the ground voltage level is supplied to the compensating voltage supply line according to the level converting control signal by using NMOS and PMOS switching devices connected in series between the ground voltage application terminal and a preset straight polarity compensating voltage application terminal.

10. The method as claimed in claim 9, further comprising the step of supplying at least one of the gate voltage and the light emitting voltage to the gate lines or the light emitting control lines after reducing application periods of the gate voltage and the light emitting voltage as much as a preset time period for at least an initial one frame period.

* * * * *